US007332067B2

(12) United States Patent
Reufer et al.

(10) Patent No.: US 7,332,067 B2
(45) Date of Patent: Feb. 19, 2008

(54) PROCESS FOR THE PREPARATION OF α-SUBSTITUTED CARBOXYLIC ACIDS FROM THE SERIES COMPRISING α-HYDROXYCARBOXYLIC ACIDS AND N-SUBSTITUTED-α-AMINOCARBOXYLIC ACIDS

(75) Inventors: Christian Reufer, Maintal (DE); Martin Hateley, Aschaffenburg (DE); Thomas Lehmann, Langenselbold (DE); Christoph Weckbecker, Gründau-Lieblos (DE); Rainer Sanzenbacher, Geinhausen (DE); Jürgen Bilz, Freigericht (DE)

(73) Assignee: Degussa AG, Essen (DE)

( * ) Notice: Subject to any disclaimer, the term of this patent is extended or adjusted under 35 U.S.C. 154(b) by 120 days.

(21) Appl. No.: 10/559,766

(22) PCT Filed: Jun. 3, 2004

(86) PCT No.: PCT/EP2004/005995

§ 371 (c)(1),
(2), (4) Date: Dec. 8, 2005

(87) PCT Pub. No.: WO2004/111309

PCT Pub. Date: Dec. 23, 2004

(65) Prior Publication Data

US 2007/0095674 A1 May 3, 2007

(30) Foreign Application Priority Data

Jun. 10, 2003 (DE) ..... 103 26 047

(51) Int. Cl.
*C25B 3/00* (2006.01)

(52) U.S. Cl. ..... 205/440; 205/442; 205/443

(58) Field of Classification Search ..... 205/440, 205/442, 443
See application file for complete search history.

(56) References Cited

U.S. PATENT DOCUMENTS

| | | | | |
|---|---|---|---|---|
| 4,238,677 | A * | 12/1980 | Hugon | 340/629 |
| 4,582,577 | A * | 4/1986 | Wagenknecht | 205/441 |
| 4,601,797 | A * | 7/1986 | Wagenknecht | 205/441 |
| 4,824,532 | A * | 4/1989 | Moingeon et al. | 205/422 |
| 6,267,866 | B1 | 7/2001 | Glesener et al. | |
| 6,475,370 | B2 * | 11/2002 | Lehmann et al. | 205/443 |

FOREIGN PATENT DOCUMENTS

| | | |
|---|---|---|
| DE | 100 40 401 A1 | 2/2002 |
| EP | 0 189 120 A1 | 7/1986 |
| FR | 2 542 764 A1 | 9/1984 |
| WO | WO 02/16671 A1 | 2/2002 |

* cited by examiner

*Primary Examiner*—Edna Wong
(74) *Attorney, Agent, or Firm*—Robert G. Weilacher; Smith, Gambrell & Russell

(57) ABSTRACT

A process for the preparation of α-substituted carboxylic acids from the series including α-hydroxycarboxylic acids and N-substituted-α-aminocarboxylic acids by cathodic carboxylation with carbon dioxide of a compound corresponding to the general formula $R^1—C(=X)R^2$ which is constituted by aldehydes, ketones or N-substituted imines. In the past, that carboxylation has taken place in an undivided electrolytic cell with the use of a sacrificial anode. As described herein, the carboxylation takes place in the absence of a sacrificial anode in an electrolytic cell divided by a separator, at a diamond film cathode. The anode is formed of a material which is stable under electrolytic conditions; in particular, it is a diamond film electrode. The catholyte includes an organic solvent and a conducting salt.

20 Claims, No Drawings

PROCESS FOR THE PREPARATION OF α-SUBSTITUTED CARBOXYLIC ACIDS FROM THE SERIES COMPRISING α-HYDROXYCARBOXYLIC ACIDS AND N-SUBSTITUTED-α-AMINOCARBOXYLIC ACIDS

This application is a national stage application filed under 35 USC 371 of PCT/EP04/05995 filed on Jun. 3, 2004.

FIELD OF THE INVENTION

The invention relates to a process for the preparation of α-substituted carboxylic acids from the series comprising α-hydroxycarboxylic acids and N-substituted α-aminocarboxylic acids by cathodic carboxylation of a compound corresponding to the general formula $R^1—C(=X)R^2$ which is here constituted by aldehydes, ketones and N-substituted imines. The invention relates in particular to a process for the preparation of 2-hydroxy-4-methylmercaptobutyric acid, hereinbelow referred to as methionine hydroxy analogue or abbreviated to MHA, from 3-methylmercaptopropionaldehyde, abbreviated to MMP.

BACKGROUND OF THE INVENTION

α-Hydroxycarboxylic acids and N-substituted aminocarboxylic acids are valuable building blocks for syntheses, and some are also utilized directly in various fields. For instance, 2-hydroxy-4-methylmercaptobutyric acid is used as an animal feed additive in a manner similar to methionine. On the industrial scale MHA is conventionally obtained from 3-methylmercaptopropionaldehyde, itself obtainable by an addition reaction between methylmercaptan and acrolein, by reaction with hydrogen cyanide followed by hydrolysis of the 4-methylmercapto-2-hydroxybutyronitrile which is formed.

Disadvantages of the last-mentioned process are the demanding safety requirements necessitated by the toxicity of hydrogen cyanide, and effluent pollution occasioned by the ammonium salt formed during the hydrolysis. Efforts to overcome the indicated disadvantages have brought to light processes in which carbon dioxide is reacted as a C1 building block with an aldehyde, ketone or imine to give the generic α-substituted carboxylic acid.

The electrochemical reaction of carbon dioxide with ketones and aldehydes with formation of α-hydroxycarboxylic acids is known from EP-A 0 189 120 and GDCH Monograph, Vol. 23 (2001), pp. 251-258. While the electrochemical carboxylation of aromatic ketones results in average-to-good yields, yields from the electrochemical carboxylation of aromatic aldehydes are moderate and those from the carboxylation of aliphatic aldehydes are low. In these cases the electrocarboxylation takes place in an undivided electrolytic cell in the presence of a sacrificial anode in an aprotic solvent which additionally contains a conducting salt.

According to WO 02/16671 an electrocarboxylation which works in accordance with the proposed principle is that of 3-methylmercaptopropionaldehyde (MMP) to obtain the methionine hydroxy analogue (MHA). When the electrolytic conditions indicated in WO 02/16671 were applied to the electrolysis in a continuous flow electrolytic cell having a plane-parallel electrode configuration, it emerged that the current efficiencies and material yields indicated in WO 02/16671 could not be attained. The current efficiencies achieved under the conditions of WO 02/16671 in this industrially more attractive cell design having a plane-parallel configuration of an Mg anode and an Mg cathode were around 13%, and the material yields were around 19%. According to a lecture by Reufer on the occasion of the $5^{th}$ International Workshop on Diamond Electrodes (May 6, 2002-Jul 6, 2002, Itzehoe) this process can be improved by using as the cathode a planar boron-doped diamond electrode and as the anode an Mg sacrificial anode.

With the use of dimethylformamide as the solvent and tetrabutylammonium tetrafluoroborate as the conducting salt and with carboxylation carried out at a current density of 6 $mA/cm^2$, in electrolysis with an Mg sacrificial anode and a diamond film cathode an MMP conversion of 66% and a current efficiency of 22% with reference to MHA formed were obtained.

In a manner analogous to the carboxylation of MMP according to WO 02/16671 A1, according to DE 100 40 401 A1, N-substituted imines can undergo cathodic carboxylation to N-substituted α-amino acids. The disadvantage here, as in the process which is acknowledged above, is the necessary use of a sacrificial anode.

OBJECT OF THE INVENTION

The object of the present invention is to provide a further process for the electrochemical carboxylation of aldehydes, in particular aliphatic aldehydes, ketones and N-substituted amines. According to a further object it should be possible to carry out the process without a sacrificial anode.

SUMMARY OF THE INVENTION

Surprisingly, it was found that the cathodic carboxylation of aldehydes, ketones and N-substituted imines is also successful without a sacrificial anode if an electrolytic cell divided by a separator, in particular an electrolytic cell divided into a cathode chamber and an anode chamber by means of an ion exchange membrane, a diamond film cathode and an anode prepared from a material which is not soluble under electrolytic conditions, such as in particular a diamond film electrode, are used.

The invention accordingly provides a process for the preparation of an α-substituted carboxylic acid from the series comprising α-hydroxycarboxylic acids and N-substituted α-aminocarboxylic acids, which includes the cathodic carboxylation with carbon dioxide at a diamond film cathode of a compound corresponding to the general formula $R^1—C(=X)R^2$, wherein $R^1$ stands for an optionally substituted radical from the series comprising linear, branched or cyclic alkyl, arylalkyl, aryl and heteroaryl, $R^2$ stands for H or a radical designated under $R^1$, X stands for O or $N—R^3$ and $R^3$ stands for a radical designated under $R^1$ or for OH, in a catholyte which comprises a conducting salt and an organic solvent, which is characterized in that the carboxylation is carried out in an electrolytic cell divided into a cathode chamber and an anode chamber with the use of an anode which is not soluble under electrolytic conditions, in particular a diamond film anode.

The sub-claims relate to preferred embodiments of the process.

DETAILED DESCRIPTION OF THE INVENTION

The compounds to be carboxylated are aldehydes, ketones and N-substituted imines. In the case of the aldehydes the aldehyde group may be bound to an aliphatic, aromatic or heterocyclic radical, wherein the aliphatic radical may be linear, branched or cyclic. The radical $R^1$ may here have one or more substituents, wherein these substituents should be substantially stable under the electrolytic conditions. Particularly preferred substituents are alkoxy groups and alkylmercapto groups. Where $R^1$ is a cycloaliphatic radical, this may have one or more heteroatoms such as, in particular, oxygen and nitrogen. Preferred aliphatic aldehydes are those such as having 2 to 12 C atoms, in particular 3 to 12 C atoms, wherein these may have one or two electrolytically stable substituents and the carbon chain also includes arylalkyl radicals. 3-methylmercaptopropion-aldehyde (MMP) is particularly preferably carboxylated by the process according to the invention.

The aromatic and heteroaromatic aldehydes which are accessible to the process according to the invention are in particular those in which $R^1$ stands for phenyl, mono- or polysubstituted phenyl, 1- or 2-naphthyl, 2-, 3- or 4-pyridyl, 2- or 3-pyrrolyl, 2- or 4-imidazolyl, 2- or 3-thiophenyl, 2- or 3-furanyl, wherein the heterocyclic ring systems may also have additionally further substituents.

The ketones to be carboxylated are aliphatic ketones and aromatic-aliphatic ketones as well as purely aromatic ketones. The aromatic-aliphatic ketones are those in which $R^1$ stands for an aromatic or a heteroaromatic and $R^2$ stands for a radical as defined under $R^1$.

Various N-substituted imines, specifically aldimines and ketimines, are also accessible to the process according to the invention, with aldimines being preferred. The carbonyl compound on which the imine is based may be aromatic, heteroaromatic, cycloaliphatic and aliphatic or aromatic-aliphatic by nature and accordingly carry radicals as defined previously for $R^1$ and $R^2$.

Where the imine carbon atom carries an aromatic or heteroaromatic ring, the ring is a mono- or polycyclic aromatic or heteroaromatic system which may itself be substituted. Preferred aromatic radicals are unsubstituted and substituted phenyl and naphthyl; the heteroaromatic radicals may be 5- and 6-membered O-heterocycles, N-heterocycles and S-heterocycles or anellated systems. Where the imine carbon atom carries an aliphatic radical, this is preferably highly branched; this applies in particular in the case of an aldimine.

The radical $R^3$ of an imine can also be aliphatic, cycloaliphatic, aromatic or heteroaromatic by nature or can stand for hydroxyl. Examples of suitable imines are N-benzylidene methylamine, N-benzylidene-tert.-butylamine, N-benzylidene aniline and N-neopentylidene aniline. According to a particular embodiment oximes in which $R^3$ therefore stands for a hydroxyl group can also be converted by carboxylation according to the invention into α-amino acids.

The divided electrolytic cell to be used according to the invention can be constructed in any manner per se; however, a construction in which the anode, the separator and the cathode are constructed in plane-parallel manner and are arranged at a variable distance from one another is preferred. Both the catholyte chamber and also the anolyte chamber have a device for the supply and removal of the respective electrolyte. If required, a device for mixing the electrolyte can be arranged within an electrolyte chamber. The anode and the cathode are connected together by a voltage source. The anolyte and the catholyte are, however, pumped in separate manner through the assigned electrode chamber. The electrolyte is preferably circulated, specifically expediently until such time as the necessary conversion is obtained. Carbon dioxide or a carbon dioxide-containing gas is expediently fed into the catholyte circuit by way of a pressure-regulating device which is attached to a supply vessel in the catholyte circuit. A plurality of cells can also be combined stack-wise to give a cell stack. The electrolytic cell or the cell stack can be operated in batch-wise or continuous manner.

A feature which is essential to the invention is that the cell has a separating element. This separating element can be a diaphragm or an ion exchanger. For example, clay diaphragms and glass diaphragms are utilizable, as well as cation and anion exchangers in the form of membranes. According to a particularly preferred embodiment a cation exchange membrane is one which is based on a sulfonated highly fluorinated polymer. Accordingly, cation exchange membranes which are commercially obtainable under the name Nafion® (from DuPont) are particularly suitable.

A so-called diamond film cathode is used as the cathode in the process according to the invention. During its manufacture the conducting diamond film is doped with one or more trivalent, pentavalent or hexavalent elements in a quantity such as to result in adequate conductivity. The doped diamond film is consequently an n-conductor or a p-conductor. Suitable doping elements are in particular boron, nitrogen, phosphorus, arsenic and antimony as well as combinations of such elements; boron as well as the combination of boron with nitrogen are particularly suitable.

The conducting diamond film of the cathode is preferably located on a conducting support material and this applies correspondingly in the case of the particularly preferred embodiment according to which the anode is also constructed as a diamond film electrode. The support materials are substances from the series comprising silicon, germanium, titanium, zirconium, niobium, tantalum, molybdenum and tungsten, as well as carbides and nitrides of the elements Ti, Si, Nb, Ta, Zr and Mo, which are stable under the electrolytic conditions in the catholyte chamber and the anolyte chamber. In addition to the named support materials, support materials from the series comprising carbonaceous steels, chromium-nickel steels, nickel, bronze, lead, carbon, tin, zirconium, platinum, nickel and alloys thereof are also considered. The reader is referred, for example, to DE 199 11 746 A1 for the preparation of diamond film electrodes.

In order to modify the properties of a diamond film electrode it can be rendered more hydrophilic by an anodic pre-treatment and more hydrophobic by a cathodic pre-treatment. It is moreover possible to fluorinate the diamond film. A further type of modification consists of incorporating into the film nanoparticles of metals and metal compounds, which are stable under the electrolytic conditions. Such materials as do not dissolve under the electrolytic conditions and anodic polarization are given consideration as anode materials for the cathodic carboxylation according to the invention. In addition to the diamond film anode already described previously, graphite, glass-carbon, carbon fibers, steels and platinum are also suitable as anode materials.

Both the catholyte and also the anolyte comprise one or more conducting salts, as well as one or more solvents. The solvent or solvents is or are selected such that the compound which is to be carboxylated as well as the α-substituted carboxylic acid or salt of the same which is formed therefrom, are soluble in a sufficient quantity.

Alkali metal halides and alkaline earth metal halides, in particular potassium chloride and potassium bromide, ammonium halides, but preferably alkyl, cycloalkyl and aryl ammonium salts, are suitable as conducting salts. Quaternary ammonium salts are particularly preferred, wherein the radicals bound to the nitrogen, which are the same or different, may be aliphatic, cycloaliphatic and aromatic by nature. The anions of the quaternary ammonium salts are in particular chloride, bromide, iodide, acetate, trifluormethylacetate, tetrafluoroborate, perchlorate, hexafluorophosphate, para-toluenesulfonate, trifluormethyl sulfate, trifluormethyl sulfonate and bis(trifluoromethyl sulfonimide). Particularly suitable conducting salts are tetra($C_1$ to $C_4$)-alkylammonium tetrafluoroborate or tetra($C_1$ to $C_4$)-alkylammonium hexafluorophosphate.

The catholyte and the anolyte can contain the same or different conducting salts; they are preferably substantially the same. The conducting salt concentration can be within a broad range; it is normally within the range 1 to 100 mmole/l, preferably within the range 10 to 20 mmole/l.

The catholyte and the anolyte comprise as the solvent for the compound which is to be carboxylated and the conducting salt one or more aprotic dipolar solvents and/or alcohols. Suitable aprotic dipolar solvents are N-substituted amides, nitriles, lactones, open-chain and cyclic ethers, sulfoxides and open-chain as well as cyclic carbonic acid esters. Such solvents can be used both singly or in the form of mixtures. Alcohols may be utilized as alternatives to, or in mixture with, such dipolar solvents. Particularly preferred aprotic dipolar solvents are dialkylamides, such as in particular dimethylformamide, N-alkyl lactams, such as in particular N-methylcaprolactam, acetone nitrile and gamma-butyrolactone as well as ethylene glycol carbonate. The utilizable alcohols are in particular monohydric or dihydric primary alcohols whereof the carbon chain is preferably interrupted by one or more ether bridges. Examples are n-propanol, propylene glycol, ethylene glycol monomethyl ether and polyethylene glycol.

It has been found that a small addition of water to the solvent system, in particular an addition within the range 0.1 to 20 vol. -%, can be expedient. In many cases the formation of oxalate, the by-product formed in the cathodic reduction of carbon dioxide, can be suppressed by a water addition without simultaneously incurring reduced selectivity of the desired carboxylation product.

Those skilled in the art will also adapt the solvent system for the catholyte and the anolyte according to that oxidation reaction to which they accord preference at the anode. For example, anions of the conducting salt can namely also be oxidized alongside solvent constituents. Since the substrate which is to be carboxylated can optionally also itself be oxidized, those skilled in the art will in such cases preferably utilize an anolyte which is substantially free of substrate, and they will moreover select a separating element such as minimizes the through-diffusion of substrate into the anode chamber.

The electrochemical carboxylation is effected by the introduction into the catholyte of carbon dioxide or a carbon dioxide-containing gas, in particular an inert gas, such as nitrogen or argon, which is enriched with carbon dioxide, and contacting of the gas-liquid mixture at the cathode at an effective cell voltage. The pressure within the cathode chamber may be atmospheric pressure or elevated pressure, in particular a pressure of up to approximately 5 bar. Where a $CO_2$-containing gas mixture is utilized, the partial $CO_2$ pressure is preferably adjusted to a value of at least 0.1 bar. In order to achieve a good mass transfer and intensive contacting of the gas-liquid mixture at the cathode, it is expedient to convert the catholyte and the carbon dioxide or carbon dioxide-containing gas into a homogeneous mixture by means of a static mixer before they enter the cathode chamber.

The electrochemical carboxylation is generally effected at a cell voltage within the range 1 to 30 V, in particular 5 to 20 V. Although it is possible to work with a potentiostatic regime, a galvanostatic regime is generally preferred. Expediently, the carboxylation is effected in galvanostatic manner at a current density within the range 0.1 to 10 A/dm$^2$, preferably 0.1 to 2 A/dm$^2$.

The electrochemical carboxylation is carried out at a temperature within the range 0° C. to 50° C., in particular 10° C. to 30° C.; however, the temperature may also be lower or higher than these limit values.

According to a particularly preferred embodiment of the invention methylmercaptopropionaldehyde is carboxylated to the dianion of 4-methylmercapto-2-hydroxybutyric acid (methionine hydroxy analogue).

As a result of the process according to the invention a further method for electrochemical carboxylation has been provided whereof the particular advantage resides in rendering the use of a sacrificial anode superfluous.

The working-up of the catholyte for the purpose of isolating the carboxylated reaction product which is dissolved or suspended therein is substantially dictated by the substance data of the compound which is to be isolated. In the individual working-up steps those skilled in the art will use the processes which are familiar to them for the working-up of reaction mixtures. Suitable process steps are, for example: (i) precipitation of a salt by the addition of a weakly polar organic solvent such as an aliphatic or cycloaliphatic hydrocarbon; (ii) filtration of the precipitated product, which is generally a salt of the α-substituted carboxylic acid with an added cation or a cation from the conducting salt, from the organic phase which contains the conducting salt and other organic solvent constituents of the catholyte; (iii) acidulation of the separated salt with a dilute mineral acid and extraction of the hydroxycarboxylic acid from the aqueous phase or isolation of the N-substituted amino acid under conditions which are known from amino acid technology; (iv) dewatering of the organic phase from stage (ii), distilling-off the weakly polar organic solvent and recycling the remaining organic phase, which contains the conducting salt, into the catholyte supply container.

EXAMPLE

Preparation of 2-hydroxy-4-methylmercaptobutyric Acid (MHA) by the Carboxylation of MMP The electrolytic cell used was equipped with a cation exchange membrane (Nafion®) and a respectively boron-doped diamond film cathode and diamond film anode.

The electrode area was 7 cm$^2$ and the electrode gap 8 mm. The catholyte and the anolyte contained tetrabutylammonium tetrafluoroborate at a concentration of 14 mmole/l as the conducting salt.

The solvent of the catholyte and the anolyte substantially comprised dimethylformamide. The feed concentration of the 3-methylmercaptopropionaldehyde (MMP) was 43 mmole/l. Electrolysis was effected at standard pressure by bubbling carbon dioxide through; the reaction temperature was 20° C. to 25° C. The regime was galvanostatic at a current density of 6.3 mA/cm$^2$.

After a period of electrolysis of 300 min 88% of the MMP was converted. The MHA current efficiency was 21% and the material yield was 27%. The material yield relative to conversion was around 31%.

Working-up: addition of n-hexane to the catholyte; filtration of the salt formed; isolation of MHA by acidulation of the salt with dilute $H_2SO_4$ and extraction with ether, phase separation, distillation of the solvent from the organic phase.

What is claimed is:

1. Process for the preparation of an α-substituted carboxylic acid selected from the group consisting of α-hydroxycarboxylic acids and N-substituted α-aminocarboxylic acids, which comprises cathodic carboxylation with carbon dioxide at a diamond film cathode of a compound corresponding to the formula $R^1—C(=X)R^2$, wherein $R^1$ stands for an optionally substituted radical selected from the group consisting of linear, branched or cyclic alkyl, arylalkyl, aryl and heteroaryl, $R^2$ stands for H or a radical designated under $R^1$, X stands for O or $N—R^3$ and $R^3$ stands for a radical designated under $R^1$, or for OH, in a catholyte comprising a conducting salt and an organic solvent, wherein the carboxylation is carried out in an electrolytic cell divided into a cathode chamber and an anode chamber with the use of an anode which is not soluble under electrolytic conditions.

2. The process according claim 1, wherein an aliphatic or aromatic-aliphatic aldehyde, which may have one or more substituents which are substantially stable under the electrolytic conditions, undergoes the cathodic carboxylation as the compound corresponding to the formula $R^1—C(=X)R^2$.

3. The process according to claim 2, wherein the compound corresponding to the formula $R^1—C(=X)R^2$ is 3-methylmercaptopropionaldehyde (MMP) undergoes the cathodic carboxylation, wherein the dianion of 2-hydroxy-4-methyl-mercaptobutyric acid (MHA) (=methionine hydroxyl analogue) is formed.

4. The process according to claim 3, wherein an electrode which is doped with one or more of elements is the cathode and anode.

5. The process according to claim 1 wherein said anode is a diamond film anode.

6. The process according to claim 1, wherein a diamond film electrode which is doped with one or more of the elements selected from the group consisting of boron, nitrogen, phosphorus, arsenic and antimony, is used as the cathode, wherein the anode and the cathode may be doped in a different or identical manner.

7. The process according to claim 6 wherein said element is boron or boron and nitrogen.

8. The process according to claim 1, which further comprises passing an anolyte containing a conducting salt through the anode chamber, and wherein the catholyte containing the conducting salt is passed through the cathode chamber wherein the conducting salt in the catholyte and the conducting salt in the anolyte may be identical or different.

9. The process according to claim 8, wherein said salts are alkali metal salts.

10. The process according to claim 9, wherein the alkali metal salts are selected from the group consisting of KCl, KBr, alkaline earth metal halides and quarternary ammonium salts.

11. The process according to claim 1, wherein the conducting salt is a tetra (C1 to C4)-alkylammonium salt wherein the anion is selected from the group consisting of tetrafluoroborate, hexafluorophosphate, trifluoromethyl sulfonate, trifluoromethyl sulfate, trifluoromethyl acetate and perchlorate.

12. The process according to claim 1, wherein the solvent for the catholyte is one or more aprotic dipolar solvents.

13. The process according to claim 12, wherein the aprotic dipolar solvents are selected from the group consisting of dialkylamides, N-alkyl lactams, nitrites, ethers, sulfoxides, gamma-butyrolactone, and alcohols.

14. The process according to claim 1, wherein the electrolytic cell has an ion exchange membrane used as a separating element.

15. The process according to claim 14, wherein the ion exchange membrane is a cation exchange membrane, a clay membrane or a glass membrane.

16. The process according to claim 1, wherein the cathodic carboxylation is carried out at a pressure within the range atmospheric pressure to 5 bar, wherein the carbon dioxide partial pressure is within the range 0.1 to 5 bar.

17. The process according to claim 1, wherein the cathodic carboxylation is carried out in the electrolytic cell wherein the diamond film cathode and the anode are plane-parallel electrodes.

18. The process according to claim 1, wherein the cathodic carboxylation is carried out in potentiostatic manner at a voltage within the range 3 to 30 V, or in galvanostatic manner at a current density within the range 0.1 to 10 $A/dm^2$.

19. The process according to claim 18, wherein the voltage is from 5 to 20 V and the current density is form 0.2 to 2 $A/dm^2$.

20. The process according to claim 1, wherein the α-hydroxycarboxylic acid or N-substituted α-aminocarboxylic acid is obtained from the catholyte, by precipitation of a salt formed from a substituted carboxylic acid anion with a cation which is contained in the electrolytic cell, by addition of a substantially nonpolar solvent, and acidulation of a salt which has been separated from an organic phase.

* * * * *